US005711284A

United States Patent [19]

Keenan, Jr.

[11] Patent Number: 5,711,284

[45] Date of Patent: Jan. 27, 1998

[54] PAINT BALL PROJECTILE ATTACHMENT DEVICE FOR BOWS

[76] Inventor: Duane Keenan, Jr., 939 Grove St., Aurora, Ill. 60505

[21] Appl. No.: 572,034

[22] Filed: Dec. 14, 1995

[51] Int. Cl.[6] ..... F41B 5/14

[52] U.S. Cl. ..... 124/49; 124/67; 124/86

[58] Field of Search ..... 124/23.1, 24.1, 124/45, 49, 50, 86, 88, 65, 66, 67

[56] References Cited

U.S. PATENT DOCUMENTS

| | | | |
|---|---|---|---|
| 1,287,197 | 12/1918 | Blackshear | 124/50 X |
| 1,319,296 | 10/1919 | Liggon | 124/49 X |
| 1,644,997 | 10/1927 | Grupka | 124/49 X |
| 1,743,576 | 1/1930 | Smith | 124/49 X |
| 2,069,821 | 2/1937 | Douglas | 124/24.1 X |
| 2,214,224 | 9/1940 | Douglas | 124/24.1 X |
| 4,261,321 | 4/1981 | Nishioka | 124/67 |
| 5,166,457 | 11/1992 | Lorenzetti | 124/49 X |

*Primary Examiner*—John A. Ricci

[57] ABSTRACT

A new and improved paint ball projectile attachment for bows comprising a housing secured to the bow. The housing has a first chamber and a second chamber therein. The first chamber is integral with the second chamber. The first chamber has an opening extending out a front end of the housing. The second chamber has an opening extending out a back end of the housing. The housing has a top end having a downwardly extending chamber adjoining the first chamber. A bin is secured to the top end of the housing. The bin has an opening in a lower portion thereof. The opening aligns with the downwardly extending chamber of the top end. Included in the device is a firing mechanism. A plurality of paint balls are positioned within the bin. The plurality of paint balls are dispensed through the opening in the bin. The paint balls are singlely positioned within the first chamber for ejection out the opening therein by the firing mechanism.

1 Claim, 4 Drawing Sheets

FIG 5
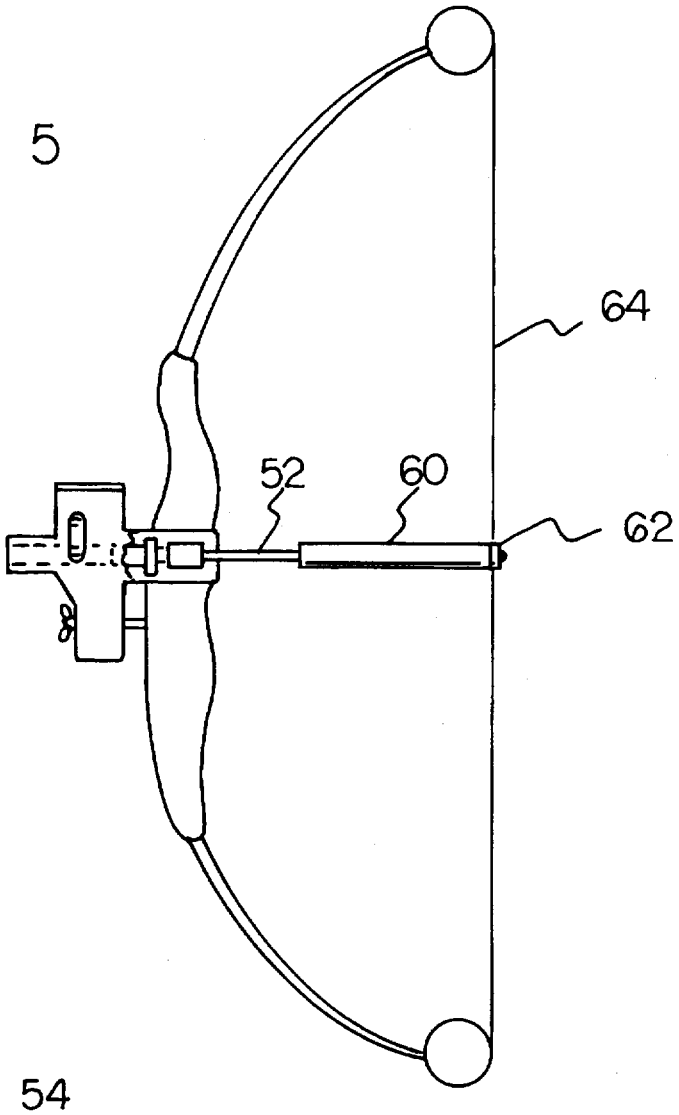
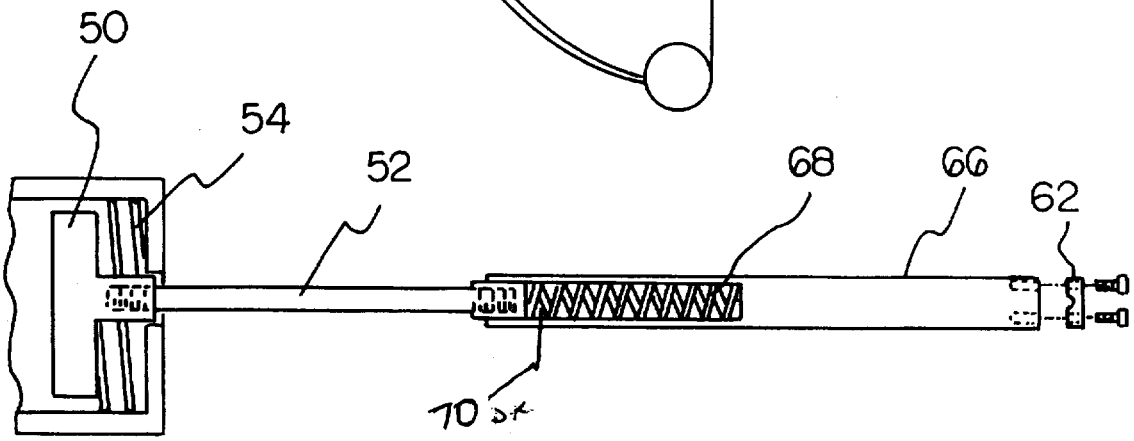
FIG 6

PAINT BALL PROJECTILE ATTACHMENT DEVICE FOR BOWS

BACKGROUND OF THE INVENTION

1. Field of the Invention

The present invention relates to a paint ball projectile attachment device for bows and more particularly pertains to securing to a bow to launch paint balls with a paint ball projectile attachment device for bows.

2. Description of the Prior Art

The use of projectile launchers is known in the prior art. More specifically, projectile launchers heretofore devised and utilized for the purpose of launching projectiles from bows are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,291,664 to Nishioka discloses a projectile shooting guide for bows.

U.S. Pat. No. 4,146,009 to Adams discloses a missile projecting aid attachment for archer's bow.

U.S. Pat. No. 3,643,643 to Jordan discloses a bow or elastic device for propelling projectiles.

U.S. Pat. No. 3,630,186 to Bayn discloses an archery bow with projectile.

U.S. Pat. No. 3,527,195 to Corlo discloses a bow device for shooting projectiles.

U.S. Pat. No. 3,108,583 to Andis discloses a projectile launcher.

While these devices fulfill their respective, particular objective and requirements, the aforementioned patents do not describe a paint ball projectile attachment for bows for securing to a bow to launch paint balls.

In this respect, the paint ball projectile attachment for bows according to the present invention substantially departs from the conventional concepts and designs of the prior art, and in doing so provides an apparatus primarily developed for the purpose of securing to a bow to launch paint balls.

Therefore, it can be appreciated that there exists a continuing need for new and improved paint ball projectile attachment for bows which can be used for securing to a bow to launch paint balls. In this regard, the present invention substantially fulfills this need.

SUMMARY OF THE INVENTION

In the view of the foregoing disadvantages inherent in the known types of projectile launchers now present in the prior art, the present invention provides an improved paint ball projectile attachment for bows. As such, the general purpose of the present invention, which will be described subsequently in greater detail, is to provide a new and improved paint ball projectile attachment for bows and method which has all the advantages of the prior art and none of the disadvantages.

To attain this, the present invention essentially comprises a housing having an upper portion and a lower portion. The lower portion is secured by a wing nut and screw that extends through the lower portion to the bow downward of an arrow groove thereof. The upper portion has a first chamber and a second chamber therein. The first chamber is integral with the second chamber. The first chamber has an opening that extends out a front end of the upper portion.

The second chamber has an opening that extends out a back end of the upper portion. The upper portion has a top end having a downwardly extending chamber that adjoins the first chamber. The device contains a bin that is secured to the top end of the upper portion of the housing. The bin has a cover hingedly secured to a side thereof. The bin has an opening in a lower portion thereof. The opening aligns with the downwardly extending chamber of the top end. A release door is pivotally secured to the lower portion. The release door optionally covers the opening therein. The device contains a sight device secured to the top end of the upper portion. The sight device has a plurality of sight pins therein. The sight device serves to provide a means for viewing a target. The device contains a firing mechanism having an internal piston that is slidably coupled with the first chamber of the upper portion of the housing. An internal spring is secured to a back end of the internal piston. An external piston has a shaft portion that extends outwardly of the opening in the second chamber of the back end of the upper portion. An external spring is coupled with a back portion of the external piston and with the shaft portion. The external spring is positionable against the back end in the second chamber. Pulling outwardly on the shaft portion causes the external spring to force the external piston inward that forces the internal spring inward to drive the internal piston through the first chamber. The device contains a plurality of paint balls that are positioned within the bin. The plurality of paint balls are optionally dispensed through the opening in the bin when the release door is removed therefrom. The paint balls are singlely positioned within the first chamber for ejection out the opening therein by the firing mechanism.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paint ball projectile attachment for bows which has all the advantages of the prior art projectile launchers and none of the disadvantages.

It is another object of the present invention to provide a new and improved paint ball projectile attachment for bows which may be easily and efficiently manufactured and marketed.

It is a further object of the present invention to provide a new and improved paint ball projectile attachment for bows which is of durable and reliable construction.

An even further object of the present invention is to provide a new and improved paint ball projectile attachment for bows which is susceptible of a low cost of manufacture with regard to both materials and labor, and which accordingly is then susceptible of low prices of sale to the consuming public, thereby making such a paint ball projectile attachment for bows economically available to the buying public.

Still yet another object of the present invention is to provide a new and improved paint ball projectile attachment for bows which provides in the apparatuses and methods of the prior art some of the advantages thereof, while simultaneously overcoming some of the disadvantages normally associated therewith.

Even still another object of the present invention is to provide a new and improved paint ball projectile attachment device for bows for securing to a bow to launch paint balls.

Lastly, it is an object of the present invention to provide a new and improved paint ball projectile attachment for bows comprising a housing secured to the bow. The housing has a first chamber and a second chamber therein. The first chamber is integral with the second chamber. The first chamber has an opening extending out a front end of the housing. The second chamber has an opening extending out a back end of the housing. The housing has a top end having a downwardly extending chamber adjoining the first chamber. A bin is secured to the top end of the housing. The bin has an opening in a lower portion thereof. The opening aligns with the downwardly extending chamber of the top end. Included in the device is a firing mechanism. A plurality of paint balls are positioned within the bin. The plurality of paint balls are dispensed through the opening in the bin. The paint balls are singlely positioned within the first chamber for ejection out the opening therein by the firing mechanism.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an elevated side view of the second embodiment of the present invention.

FIG. 6 is a cross-sectional view of the second embodiment of the present invention.

The same reference numerals refer to the same parts through the various Figures.

DESCRIPTION OF THE PREFERRED EMBODIMENT

Figure 1:
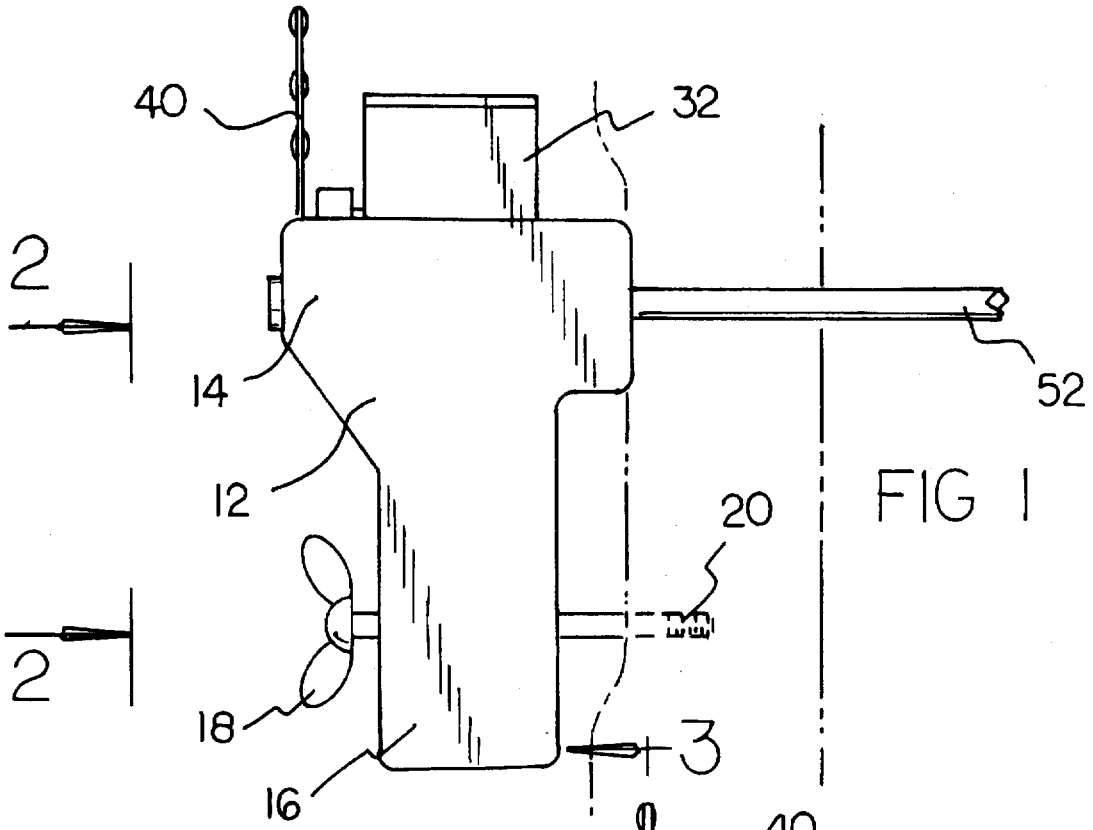
FIG. 1 is a perspective view of the preferred embodiment of the paint ball projectile attachment for bows constructed in accordance with the principles of the present invention.

With reference now to the drawings, and in particular, to FIG. 1 thereof, the preferred embodiment of the new and improved paint ball projectile attachment for bows embodying the principles and concepts of the present invention and generally designated by the reference number 10 will be described.

Specifically, it will be noted in the various Figures that the device relates to a new and improved paint ball projectile attachment device for bows for securing to a bow to launch paint balls. In its broadest context, the device consists of a housing, a bin, a sight device, a firing mechanism, and a plurality of paint balls.

The device 10 contains a housing 12 having an upper portion 14 and a lower portion 16. The lower portion 16 is secured by a wing nut 18 and screw 20 that extends through the lower portion 16 to the bow downward of an arrow groove thereof. This is easily accomplished by screwing the device 10 into the bow's front stabilizer port. The wing nut 18 is attached to the threaded rod 20 which in turn is screwed into the front stabilizer part of the bow. This is how the device is mounted to the bow. A bow could also be sold that has the device 10 already incorporated into it. The upper portion 14 has a first chamber 22 and a second chamber 24 therein. The first chamber 22 is integral with the second chamber 24. The first chamber 22 is about half as wide as the second chamber 24. The first chamber 22 has an opening 26 that extends out a front end of the upper portion 14. This opening 26 represents the firing hole of the device 10. The second chamber 24 has an opening 28 that extends out a back end of the upper portion 14. The upper portion 14 has a top end having a downwardly extending chamber 30 that adjoins the first chamber 22. The downwardly extending chamber 30 is the means for loading the device 10.

The device 10 contains a bin 32 that is secured to the top end of the upper portion 14 of the housing 12. The bin 32 encompasses about half of the top end of the housing 12. The bin 32 has a generally rectangular configuration. The bin 32 has a cover 34 hingedly secured to a side thereof. The bin 32 has an opening 36 in a lower portion thereof. The opening 36 aligns with the downwardly extending chamber 30 of the top end. A release door 38 is pivotally secured to the lower portion. The release door 38 optionally covers the opening 36 therein. Simply pulling on the release door 38 will reveal the opening 36 and provide access to the downwardly extending chamber 30.

The device 10 contains a sight device 40 secured to the top end of the upper portion 14. The sight device 40 has a plurality of sight pins 42 therein. The sight device 40 serves to provide a means for viewing a target. The user simply looks through the sight pins 42 to take aim on the target. This feature allows the user to be more accurate with the device 10.

The device 10 contains a firing mechanism that is coupled with respect to the first chamber 22 of the upper portion 14 of the housing 12. An internal piston 50 has a shaft portion 52 that extends outwardly of the opening 28 in the second chamber 24 of the back end of the upper portion 14. An internal spring 54 is coupled with a back portion of the internal piston 50 and with the shaft portion 52. The internal spring 54 is positionable against the back end in the second chamber 24. Pulling outwardly on the shaft portion 52 causes a vacuum in chamber 24. This causes the internal spring 54 to force the internal piston 50 inward that pushes the air now in the second chamber 24 through the first chamber 22. This process will eject anything that is situated within the first chamber 22 out of the opening 26.

The device 10 contains a plurality of paint balls 56 that are positioned within the bin 32. The plurality of paint balls 56 are optionally dispensed through the opening 36 in the bin 30 when the release door 38 is removed therefrom. The paint balls 56 are singlely positioned within the first chamber 22 for ejection out the opening 26 therein by the firing mechanism 44. The paint balls 56 serve to hit the targets that are being sighted. When the paint balls 56 hit the target, they leave an impressionable mark on the target resembling blood.

A second embodiment of the present invention is shown in FIG. 5 and FIG. 6 and includes substantially all of the components of the present invention wherein a spring loaded connection assembly 60 is coupled around a distal end of the shaft portion 52. The connection assembly 60 has a securement bracket 62 secured thereto for removable coupling with a bow string 64 of the bow. The spring loaded connection assembly 60 further includes a housing portion 66. The housing portion 66 has an elongated spring 68 secured within a chamber 70 therein. The chamber 70 slidably receives the shaft portion 52 of the firing mechanism 44 therein whereby drawing back on the bow string 64 compresses spring 54 and causes the elongated spring 68 to expand. The release of the bow string 64 will push forward the housing portion 66 causing the elongated spring 68 to recoil thereby thrusting the shaft portion 52 inwardly. This process will eject anything that is situated within the first chamber 22 out of the opening 26, preferably the plurality of paint balls 56.

Figure 7:
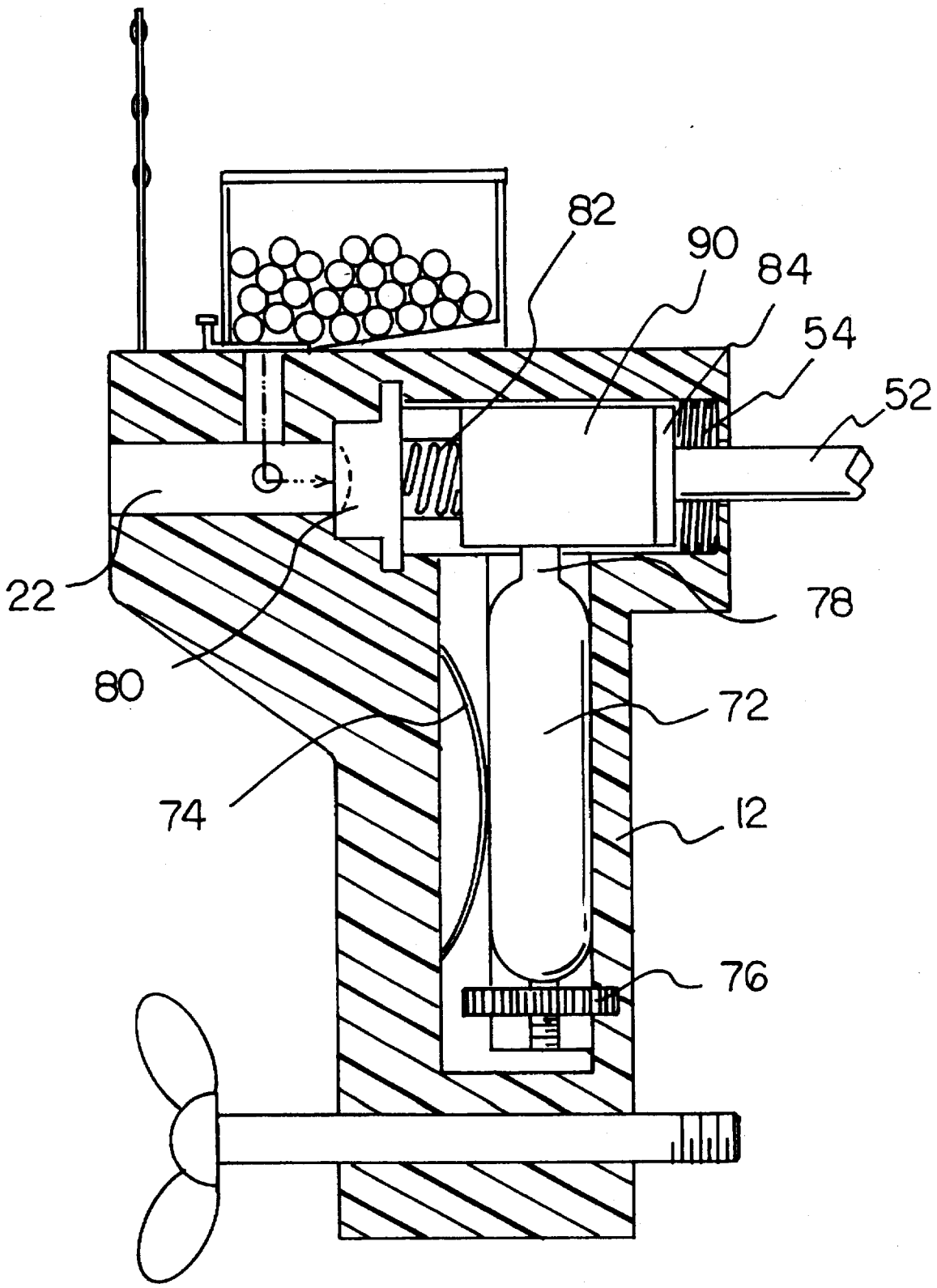
FIG. 7 is a cross-sectional view of the third embodiment of the present invention.

A third embodiment of the present invention is shown in FIG. 7 and includes substantially all of the components of the present invention and further including an altered firing mechanism including a pressure tank 72 situated within the housing 12. The pressure tank 72 is secured within the housing 12 by a leaf spring 74. The leaf spring 74 precludes movement of the pressure tank 72 within the housing 12. The pressure tank 72 has a control knob 76 thereon. The control knob 76 is used to puncture the tank 72. The pressure tank 72 has an outlet line 78 leading into the cylinder of the housing 12. The first chamber 22 has an internal piston 80 slidably secured therein. The internal piston 80 has a spring 82 secured thereto. The second chamber 90 has an external piston 84 slidably secured therein. The internal piston 80 and spring 82 are attached to the second chamber 90. A return spring 54 is coupled with the external piston 84. The external piston 84 has a shaft portion 52 secured thereto extending outwardly of the housing 12. By adding pressure within the housing 12, the user pulls back on the shaft portion 52. Once the user releases the shaft portion 52 the external piston 84 pushes inwardly. This drives the cylinder forward causing spring 82 to be compressed. This releases the air which was in the second chamber 90. This air flow causes the paint ball 56 to be ejected out of the first chamber 22.

By pulling back the bow string with the arrow 52 attached, the spring 54 is compressed while spring 68 is pulled apart. The part 50 acts like a plunger. Now the bow is at full draw. This action creates a vacuum in the area 24. Releasing the bow string pushes the arrow shaft 28 forward causing spring 54 to expand and spring 68 to compress. Note in the Figures that area 24 has a plunger pushing through it. This allows the paint ball to be pushed out of the cylinder 22. The only thing that touches the paint ball is air. That is what projects the paint ball. The reason that there is a spring 68 in the arrow shaft is to absorb some of the kinetic energy created by pulling the bow spring back.

Figure 2:
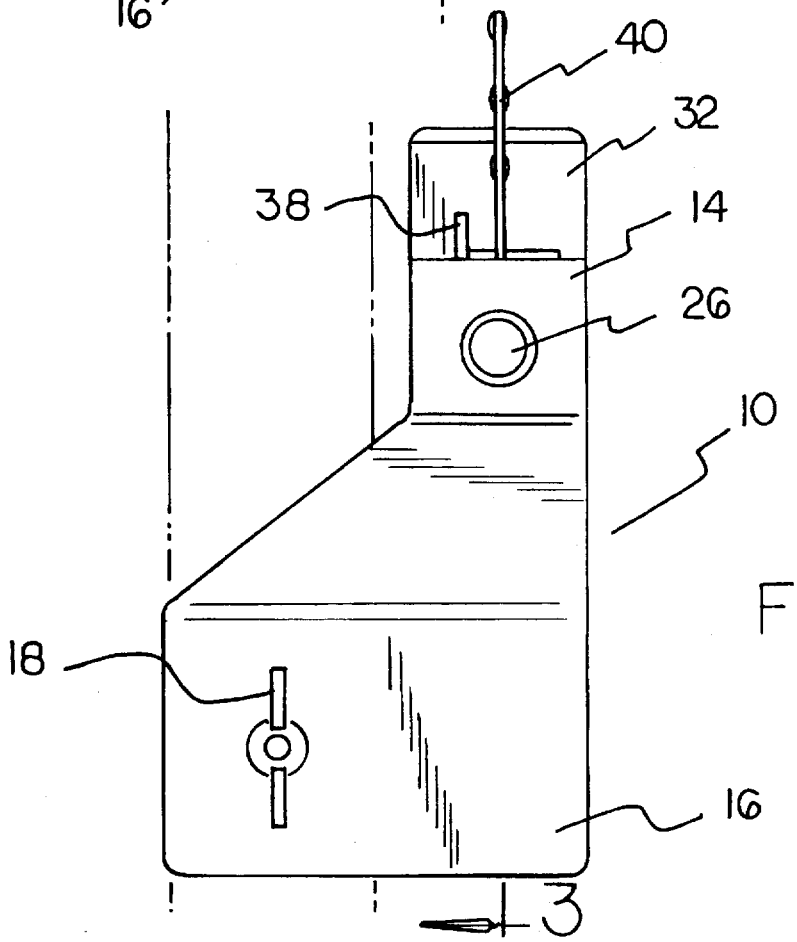
FIG. 2 is an elevated front view of the present invention.
Figure 3:
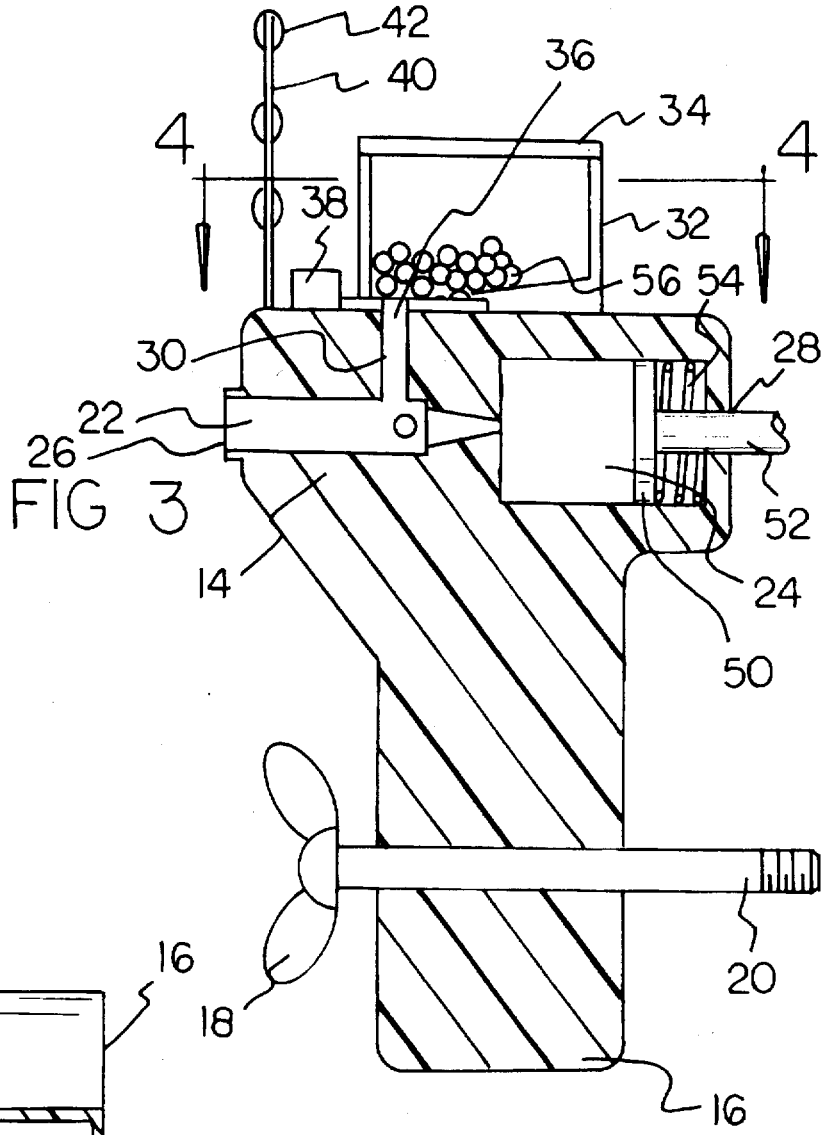
FIG. 3 is a cross-sectional view as seen along line 3—3 of FIG. 2.
Figure 4:
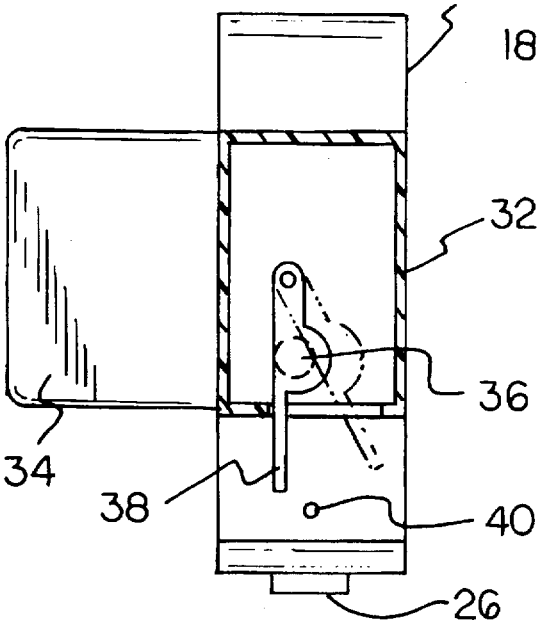
FIG. 4 is a cross-sectional view taken along line 4—4 of FIG. 3.

Loading the pressure tank 72, preferrably containing carbon dioxide, into the device involves simply placing the tank into the rectangular area to the right of the leaf spring 74. Note FIG. 7. Now by screwing the knob 76, it will travel upwardly which pushes the tank upward into the cylinder 24. There is a point on the device which will puncture the cap on the tank as is conventional. Now cylinder 24 will become filled with carbon dioxide. Note FIG. 2. By pulling back the bow string, the spring 86 is pulled apart. Now the device is at full draw. By releasing the bow string, the plunger 84 hits the cylinder causing spring 82 to compress. This allows only the air in the cylinder to be pushed out of the front end 80 projecting the paint ball. When the spring 82 expands again, it pulls pressurized gas from the tank and is ready to be used again.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A paint ball projectile system (10) as for bows for securing to a bow to launch paint balls (56) comprising, in combination:

a housing (12) securable to a bow, the housing (12) having a first chamber (22) and a second chamber (24) therein, the first chamber (22) integral, and in pneumatic communication, with the second chamber (24), the first chamber (22) having an opening (26) extending out a front end of the housing (12), the second chamber (24) having an opening (28) extending out a back end of the housing (12), the housing (12) having a top end having a downwardly extending chamber (30) adjoining the first chamber (22);

a bin (32) secured to the top end of the housing, the bin (32) having an opening (36) in a lower portion thereof, the opening (36) aligning with the downwardly extending chamber (30) of the top end;

an internal piston (50) and an internal spring (54) there adjacent and with an associated shaft (52) having an internal end slidably disposed within the second chamber (24) of the housing (12), the shaft (52) extending through the opening (28) with an external end couplable to a bow string for effecting the movement thereof;

a plurality of paint balls (56) positioned within the bin (32), the plurality of paint balls (56) dispensed through the opening (36) in the bin (32), the paint balls (56) singlely positionable within the first chamber (22) for ejection out the opening therein by the forward movement of the internal piston, internal spring and shaft;

a release door (38) pivotally secured to the lower portion of the bin (32), the release door optionally covering the opening therein; and a sight device secured to the top end of the housing, the sight device having a plurality of sight pins therein, the sight device serving to provide a means for viewing a target.

* * * * *